US012312888B2

(12) United States Patent
Madan et al.

(10) Patent No.: US 12,312,888 B2
(45) Date of Patent: May 27, 2025

(54) EXTERNAL INTERVENTION DOWNHOLE DRILLING AND WORKOVER TOOL

(71) Applicant: SAUDI ARABIAN OIL COMPANY, Dhahran (SA)

(72) Inventors: Mohammed Ali Madan, Dhahran (SA); Ibrahim Abdullah Althowiqeb, Dhahran (SA); Fahad Ghazi Moqati, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/066,608

(22) Filed: Dec. 15, 2022

(65) Prior Publication Data

US 2024/0200418 A1 Jun. 20, 2024

(51) Int. Cl.

| | |
|---|---|
| ***E21B 29/00*** | (2006.01) |
| ***E21B 10/633*** | (2006.01) |
| ***E21B 23/01*** | (2006.01) |

(52) U.S. Cl.

CPC ..... *E21B 29/007* (2013.01); *E21B 10/633* (2013.01); *E21B 23/01* (2013.01); *E21B 29/002* (2013.01)

(58) Field of Classification Search

CPC .... E21B 29/002; E21B 29/007; E21B 31/002; E21B 31/16; E21B 10/633; E21B 27/02

See application file for complete search history.

(56) References Cited

U.S. PATENT DOCUMENTS

| | | | | |
|---|---|---|---|---|
| 1,371,627 | A * | 3/1921 | Kirtley | E21B 27/02 294/68.25 |
| 1,625,414 | A * | 4/1927 | Kammerer | E21B 29/007 175/251 |
| 2,177,886 | A * | 10/1939 | Halliburton | E21B 31/002 166/178 |
| 2,511,358 | A * | 6/1950 | Mayer | B23D 21/08 30/347 |
| 7,909,100 | B2 | 3/2011 | Bryant, Jr. et al. | |
| 10,513,901 | B2 | 12/2019 | O'Rourke et al. | |
| 2006/0137877 | A1 | 6/2006 | Watson et al. | |
| 2014/0138083 | A1* | 5/2014 | Fanini | E21B 49/06 166/55.2 |
| 2023/0323738 | A1* | 10/2023 | Cassidy | E21B 47/12 166/65.1 |

* cited by examiner

*Primary Examiner* — D. Andrews
*Assistant Examiner* — Ronald R Runyan
(74) *Attorney, Agent, or Firm* — Vorys, Sater, Seymour and Pease LLP

(57) ABSTRACT

A downhole workover tool includes an elongate, cylindrical body having opposing lower and upper ends and defining an interior sized to receive a selected portion of a wellbore tubular via the lower end, and a plurality of insert tools receivable within a corresponding plurality of insert chambers (cavities) provided about an outer circumference of the body. At least one of the plurality of insert tools provides slips operable to grippingly engage an outer circumference of the selected portion of the wellbore tubular and thereby prevent the upper portion of the wellbore tubular from reversing out of the interior once received therein. The tool is then operated to mechanically or chemically cut the selected portion of the wellbore tubular.

17 Claims, 6 Drawing Sheets

EXTERNAL INTERVENTION DOWNHOLE DRILLING AND WORKOVER TOOL

FIELD OF THE DISCLOSURE

This invention relates generally to oil and gas exploration and, in particular, to wellbore workover operations to locate and cut wellbore tubulars.

BACKGROUND OF THE DISCLOSURE

In the oil and gas industry, when a wellbore is drilled a number of wellbore tubulars, conventionally referred to as casings or liners, are installed in the wellbore to prevent collapse of the drilled borehole wall and to prevent undesired outflow of drilling fluid into the formation or inflow of fluid from the formation into the wellbore. The wellbore is drilled in intervals whereby a casing to be installed in a lower borehole interval is lowered through a previously installed casing of an upper borehole interval. As a consequence of this procedure the casing of the lower interval is of smaller diameter than the casing of the upper interval, and the casings are thus installed in a nested arrangement with casing diameters decreasing in downward direction. Cement annuli are provided between the outer surfaces of the casings and the borehole wall (or other casings) to seal the casings from the borehole wall.

For a variety of reasons, it is sometimes desirable to remove a portion of a casing or liner, and well operators sometimes find that the interior of the casing is blocked. For instance, in some applications, production fluids from formation reservoirs can create accumulated scales that might affect interior accessibility. In other applications, or in addition thereto, materials or tools may be left downhole and prevent interior intervention. In such applications, the casing must be cut from the outer surface of the casing, which may entail utilizing external cutting tools and procedures within a limited annular space.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a downhole workover tool is described and may include an elongate, cylindrical body having opposing lower and upper ends and defining an interior sized to receive an upper portion of a wellbore tubular via the lower end. A plurality of insert tools may be receivable within a corresponding plurality of insert chambers provided about an outer circumference of the body. At least one of the plurality of insert tools may provide slips operable to grippingly engage an outer circumference of the upper portion of the wellbore tubular and thereby prevent the upper portion of the wellbore tubular from reversing out of the interior once received therein.

According to an additional embodiment consistent with the present disclosure, a method of undertaking a downhole workover operation includes conveying a downhole workover tool into a wellbore having a wellbore tubular positioned therein, the downhole workover tool including an elongate, cylindrical body having opposing lower and upper ends and defining an interior, and a plurality of insert tools receivable within a corresponding plurality of insert chambers provided about an outer circumference of the body. The method may further include receiving an upper portion of the wellbore tubular into the interior via the lower end of the body, anchoring the downhole workover tool to the upper portion of the wellbore tubular by grippingly engaging an outer circumference of the upper portion of the wellbore tubular with at least one of the plurality of insert tools, and cutting into the upper portion of the wellbore tubular with at least one of the plurality of insert tools.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
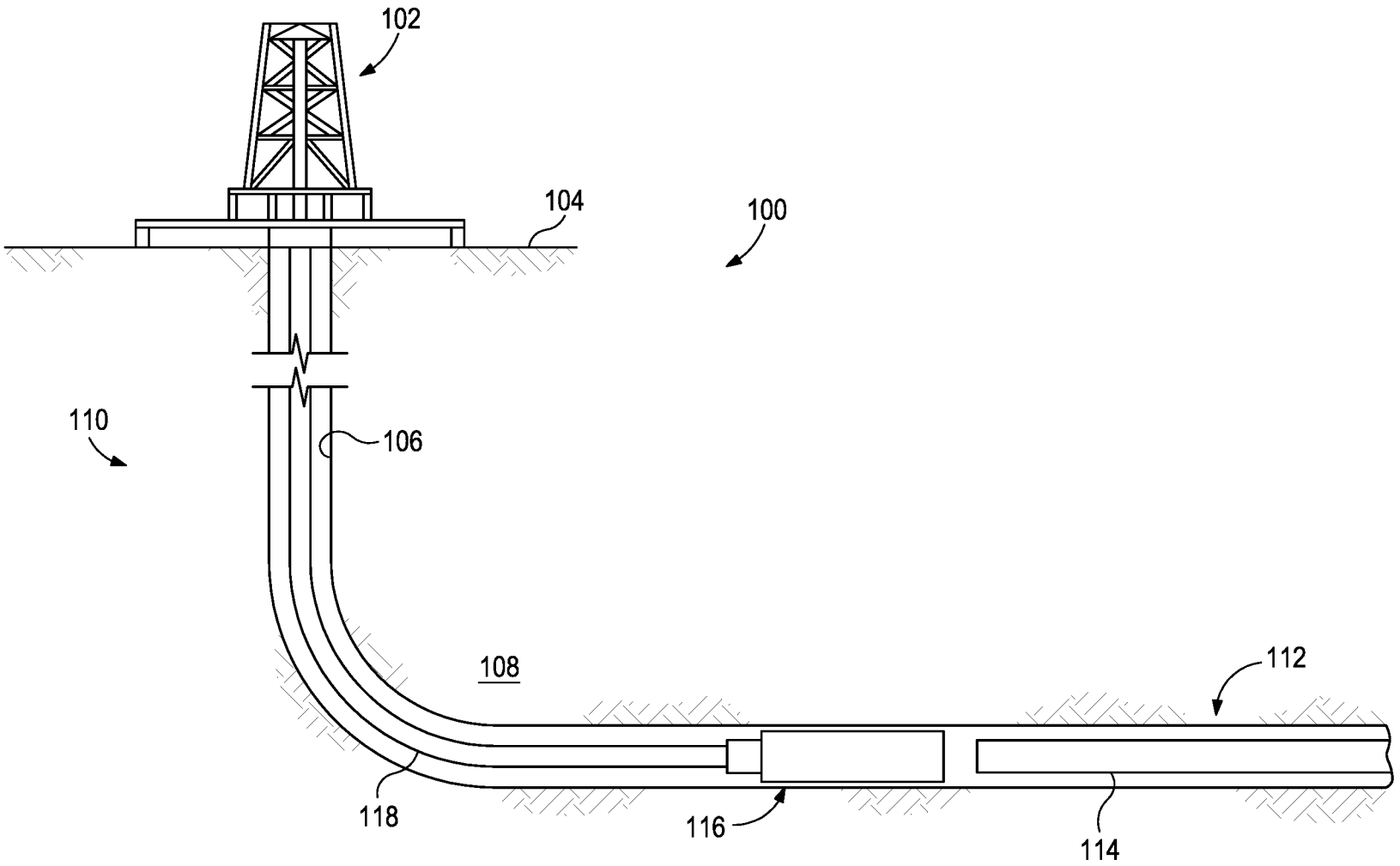
FIG. 1 is a schematic diagram of an example well system that may employ one or more principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to oil and gas exploration and, in particular, to wellbore workover operations to locate and cut wellbore tubulars, such as casing or liner strings. The key elements of a downhole fishing operation include an understanding of the dimensions and nature of the fish (i.e., downhole object) to be removed, the wellbore conditions, the tools and techniques employed, and the process by which the recovered fish will be handled at surface. However, when it comes to accessing fish in limited spaces with small diameters and cross-sections, it can become difficult to retrieve the fish.

Accordingly, prior to initiating a downhole fishing operation, it may be advantageous to undertake a workover operation in an attempt to cut and retrieve various portions of the downhole object. Embodiments described herein discuss a downhole workover tool configured to anchor to a downhole object, such as casing or liner, and mechanically or chemically cut the downhole object from its outer circumference, while holding the downhole object in tension. The severed portion of the downhole object can then be extracted or removed from the wellbore. More particularly, embodiments disclosed herein describe methods that serve the need of performing external cutting of downhole objects by mechanical or chemical means, along with the capability to anchor to the downhole object and thereby place the object in tension.

FIG. 1 is a schematic diagram of an example well system 100 that may employ one or more principles of the present disclosure. As illustrated, the well system 100 (hereafter "the system 100") may include a service rig 102 positioned on the Earth's surface 104 and extending over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation, without departing from the scope of the disclosure. Moreover, while the well system 100 is depicted as a land-based operation, it will be appreciated that the principles of the present disclosure could equally be applied in any offshore, sea-based, or sub-sea application where the service rig 102 may be a floating platform, a semi-submersible platform, or a sub-surface wellhead installation as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the Earth's surface 104 and transition into a substantially horizontal wellbore portion 112. As illustrated, a wellbore tubular 114 may be arranged within the wellbore 106. While the wellbore tubular 114 is shown positioned within the horizontal wellbore portion 112, the wellbore tubular 114 may alternatively be arranged in the vertical wellbore portion 110, without departing from the scope of the disclosure. The primary objective is to support drilling and workover operations in the oil and gas industry via enhancing cutting and retrieving methodologies within very limited spaces, which can save the time and effort.

The wellbore tubular 114 may comprise any type of downhole tubing, pipe, or conduit commonly used in the oil and gas industry and, in particular, in downhole wellbore environments. Examples of the wellbore tubular 114 include, but are not limited to, casing, liners, drill pipe, production tubing, completion tubing, or any combination thereof. For purposes of the present disclosure, however, the wellbore tubular 114 will be referred to herein as "casing 114". In some embodiments, the casing 114 may comprise a string of tubular casing sections connected end to end and cemented into place along a portion of the wellbore 106. The casing 114 may exhibit a variety of diameters common to the oil and gas industry, such as 4.5 inch or 7 inch, but could alternatively exhibit diameters smaller or larger, without departing from the scope of the disclosure. In at least one embodiment, the casing 114 may comprise 4.5 inch casing arranged within a string of 7 inch casing.

The system 100 further includes a downhole workover tool 116, alternately referred to as a Multi-Function Apparatus and Cutting Tool or "MFACT". The downhole workover tool 116 (hereafter "the tool 116") may be conveyable into the wellbore 106 on a conveyance 118 that extends from the service rig 102. In at least one embodiment, the conveyance 118 may comprise a string of drill pipe. However, the conveyance 118 may alternatively comprise other types of downhole conveyances including, but not limited to, production tubing, coiled tubing, wireline, slickline, or any combination thereof. For purposes of the present disclosure, however, the conveyance 118 will be referred to herein as "the drill pipe 118".

As described herein, the tool 116 may be used in well intervention operations, in both drilling and workover operations. In particular, the tool 116 may be used and otherwise operated to anchor, cut, and retrieve desired objects from the wellbore 106, such as the casing 114. As discussed below, the tool 116 may be configured to locate the casing 114 and extend about or over (e.g., swallow) the outer circumference of the upper end of the casing 114. Once the targeted part of the casing 114 (e.g., the upper end) is received within the interior of the tool 116, the tool 116 may then be operable to anchor itself to the casing 114 and subsequently cut (sever) the upper end of the casing 114. The conveyance 118 may then be retracted (pulled) to the surface 104, thus bringing the tool 116 and the excised portion of the casing 114 to the surface as well.

Use of directional terms herein, such as above, below, upper, lower, upward, downward, uphole, downhole, and the like, are used in relation to the illustrative embodiments as they are depicted in the figures, the upward or uphole direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the service rig 102, and the term "distal" refers to the portion of the component that is furthest from the service rig 102.

Figure 2A:
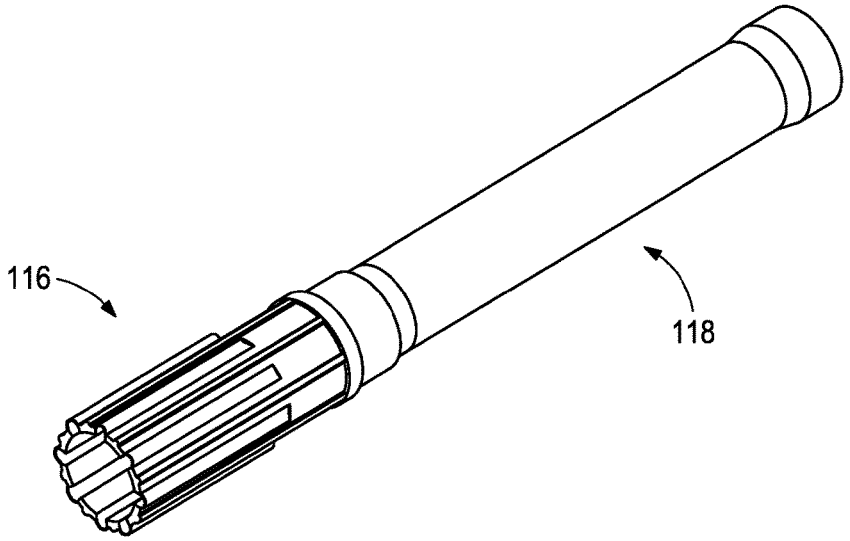
FIGS. 2A and 2B are isometric views of the downhole workover tool of FIG. 1, according to one or more embodiments.
Figure 2B:
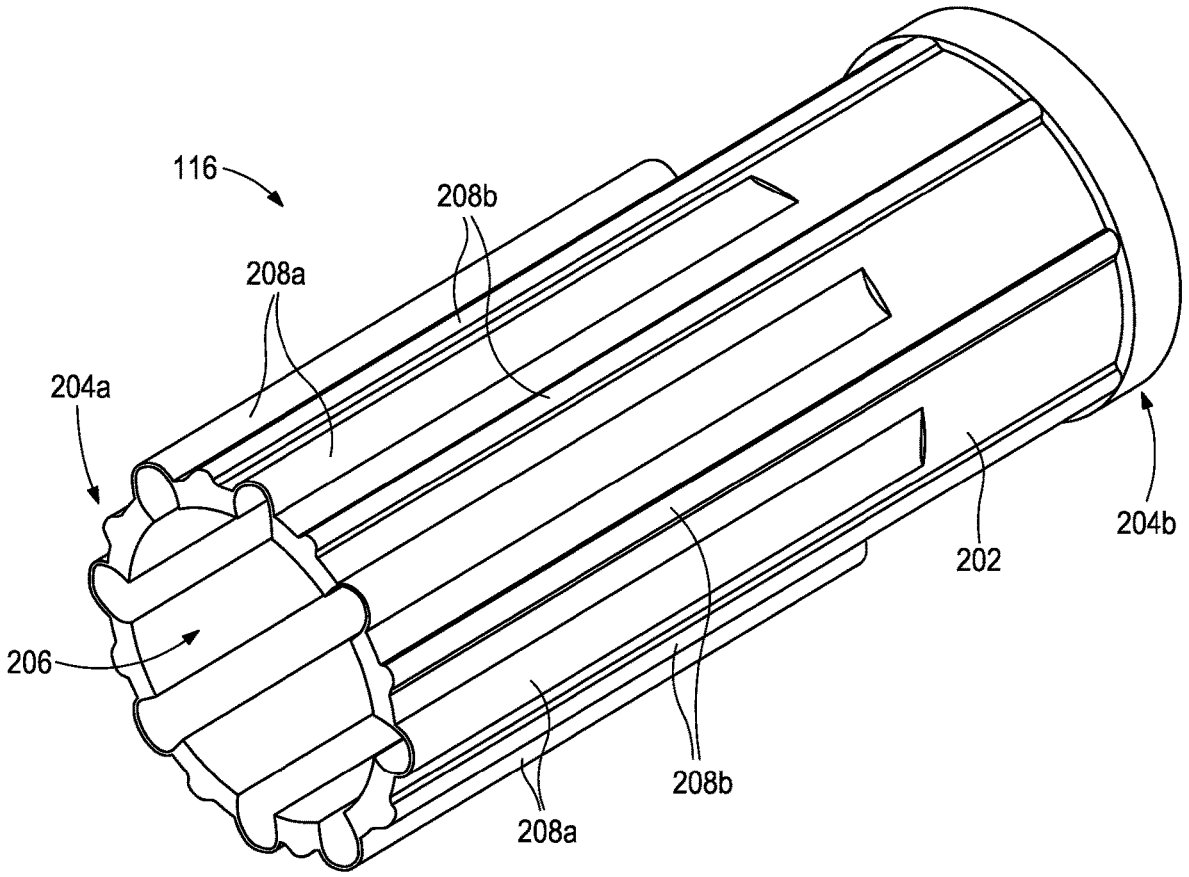

FIGS. 2A and 2B are isometric views of the tool 116, according to one or more embodiments. More specifically, FIG. 2A depicts the tool 116 operatively coupled to the drill pipe 118, and FIG. 2B is an enlarged isometric view of the tool 116. The tool 116 may be operatively coupled to the drill pipe 118 via any conventional means including, but not limited to, a threaded engagement, one or more mechanical fasteners, a removable attachment, welding, an adhesive, or any combination thereof.

Referring to FIG. 2B, the tool 116 may include an elongate, cylindrical body 202 having a first or "lower" end 204*a* and a second or "upper" end 204*b* opposite the lower end 204*a*. As illustrated, the body 202 may exhibit a generally circular cross-section, but could exhibit other cross-sectional shapes, without departing from the scope of the disclosure. The body 202 also provides or otherwise defines an interior 206 extending between the lower and upper ends 204*a,b*. In some embodiments, the interior 206 of the body 202 may fluidly communicate with an interior of the drill pipe 118. As described in more detail below, the lower end 204*a* may be configured to receive an upper portion of the casing 114 (FIG. 1) within the interior 206 for a workover operation.

As illustrated, the body 202 may provide and otherwise define a plurality of insert chambers, depicted as a plurality of first or "primary" insert chambers 208*a* and a plurality of second or "secondary" insert chambers 208*b*. In the illustrated embodiment, the tool 116 includes eight primary insert chambers 208*a* and eight secondary insert chambers 208*a*, but could alternatively include more or less than eight primary or secondary insert chambers 208*a,b*, without departing from the scope of the disclosure. In some embodiments, as illustrated, the position or arrangement of the primary and secondary insert chambers 208*a,b*, may alternate about the outer circumference of the body 202. In other embodiments, however, the primary and secondary insert chambers 208*a,b* may be arranged in any desired order, depending on the application.

The insert chambers 208*a,b* may each comprise a generally elongate and cylindrical channel, groove, or cavity that occupies a specific volume of the body 202. In at least one embodiment, the structure of the insert chambers 208*a,b* may result in a plurality of longitudinally extending ribs being defined on the outer circumference or outer radial surface of the body 202. In other embodiments, however, one or more of the insert chambers 208*a,b* may be defined entirely within the sidewall thickness of the body 202, thereby not resulting in the creation of longitudinal ribs. As described in more detail below, each insert chamber 208*a,b* may be sized and otherwise configured to receive a corresponding insert tool (not shown) configured to undertake one or more well intervention and workover operations.

In some embodiments, as illustrated, the secondary insert chambers 208*b* may be axially longer than the primary insert chambers 208*a*. In other embodiments, however the primary insert chambers 208*a* may be axially longer than the secondary insert chambers 208*b*, or the primary and secondary insert chambers 208*a,b* may exhibit the same axial length, without departing from the scope of the disclosure. Moreover, while the axial length of each primary insert chamber 208*a* is depicted in FIG. 2B as the same, the axial length of one or more the primary insert chambers 208*a* may be different from the axial length of one or more of the other primary insert chambers 208*a*. Similarly, while the axial length of each secondary insert chamber 208*b* is depicted in FIG. 2B as the same, the axial length of one or more of the secondary insert chambers 208*b* may be different from the axial length of one or more of the other secondary insert chambers 208*b*.

Figure 2D:
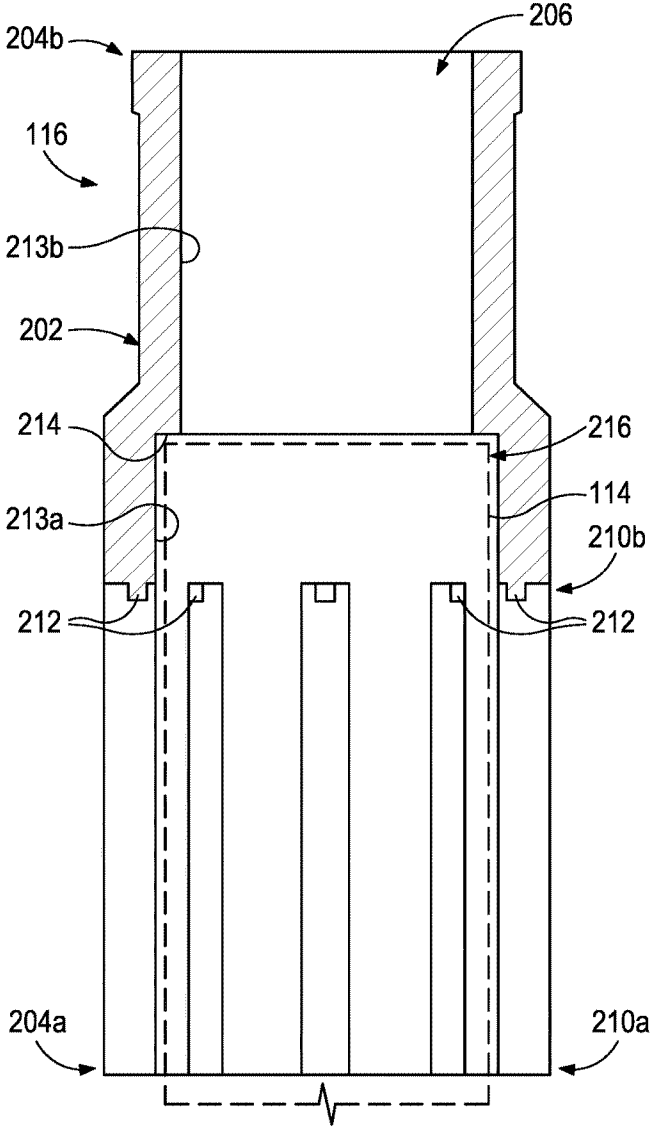
FIG. 2D is a cross-sectional side view of the downhole workover tool, as taken along the lines indicated in FIG. 2C, according to one or more embodiments.
Figure 2C:
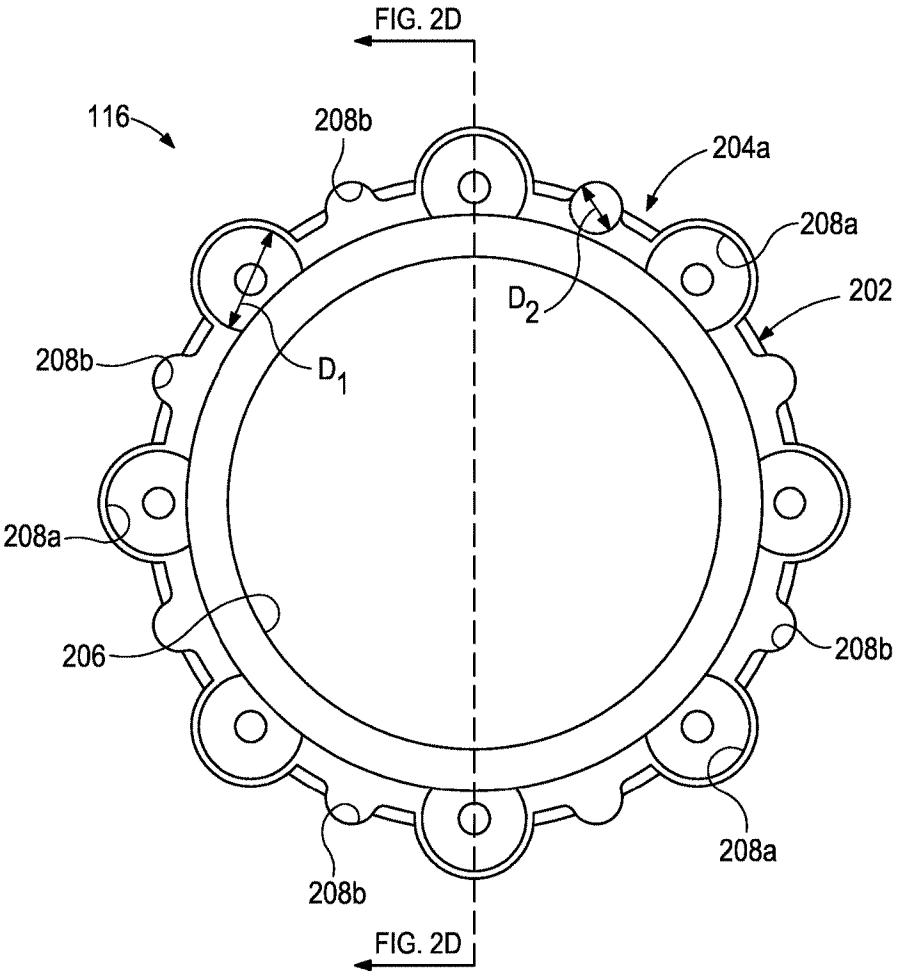
FIG. 2C is an end view of the downhole workover tool of FIGS. 2A-2B, according to one or more embodiments.

FIG. 2C is an end view of the tool 116, according to one or more embodiments. More specifically, FIG. 2C is a schematic view of the lower end 204*a* of the tool 116. As indicated above, the body 202 can exhibit a circular cross-sectional shape and defines the interior 206. In some embodiments, as illustrated, the primary and secondary insert chambers 208*a,b* may be equidistantly spaced about the outer circumference of the body 202. In other embodiments, however, the primary and secondary insert chambers 208*a,b* may be non-equidistantly spaced, without departing from the scope of the disclosure.

In some embodiments, a diameter $D_1$ of the primary insert chambers 208*a* may be larger than a diameter $D_2$ of the secondary insert chambers 208*b*. In other embodiments, however, the second diameter $D_2$ may be larger than the diameter $D_1$ of the primary insert chambers 208*a*, or the primary and secondary insert chambers 208*a,b* may exhibit the same diameter, without departing from the scope of the disclosure. Moreover, while each primary insert chamber 208*a* is depicted as having the same diameter $D_1$, one or more the primary insert chambers 208*a* may exhibit a diameter different from one or more of the other primary insert chambers 208*a*. Similarly, while each secondary insert chamber 208*b* is depicted as having the same diameter $D_2$, one or more the secondary insert chambers 208*b* may exhibit a diameter different from one or more the other secondary insert chambers 208*b*. The diameter $D_1$, $D_2$ of each insert chamber 208*a,b* may be generally constant from one end to the other, but could alternatively very, without departing from the scope of the disclosure.

FIG. 2D is a cross-sectional side view of the tool 116, as taken along the lines indicated in FIG. 2C, according to one or more embodiments. In FIG. 2D, some of the primary insert chambers 208*a* are shown. It should be noted, however, that the following description of the primary insert chambers 208*a* is equally applicable to the secondary insert chambers 208*b* (not shown).

As illustrated, each primary insert chamber 208*a* has a first or "distal" end 210*a* and a second or "proximal" end 210*b* opposite the distal end 210*a*. Once or more of the distal ends 210*a* may align flush with the lower end 204*a* of the body 202. In other embodiments, however, one or more of the distal end 210*a* may terminate axially above the distal end 210*a*, without departing from the scope of the disclosure.

In some embodiments, as illustrated, a mounting member 212 may be provided at the proximal end 210*b* of one or more of the primary insert chambers 208*a*. The mounting member 212 may be configured to help secure or rotatably mount a corresponding insert tool (not shown) within the corresponding primary insert chamber 208*a*. As described herein, some of the insert tools may be fixed within corresponding primary (and secondary) insert chambers 208*a*, but other insert tools may be configured to rotate during operation of the tool 116.

As indicated above, the interior 206 of the body 202 may extend between the lower and upper ends 204*a,b*. In some embodiments, as illustrated, the interior 206 may include a first or "lower" section 213*a* and a second or "upper" section 213*b*. The lower section 213*a* exhibits a diameter that is greater than the diameter of the upper section 213*b*, and the lower section 213*a* transitions to the upper section 213*b* at a radial shoulder 214. The lower section 213*a* may be sized and otherwise configured to receive an upper end 216 of the casing 114 (shown in dashed lines). The radial shoulder 214 may operate as a hard stop defined within the interior 206. More specifically, during operation of the tool 116, the body 202 may be advanced over the upper end 216 of the casing 114 until the upper end 216 engages the radial shoulder 214, at which point the casing 114 will be properly received within the interior 206 of the tool 116.

Figure 3B:
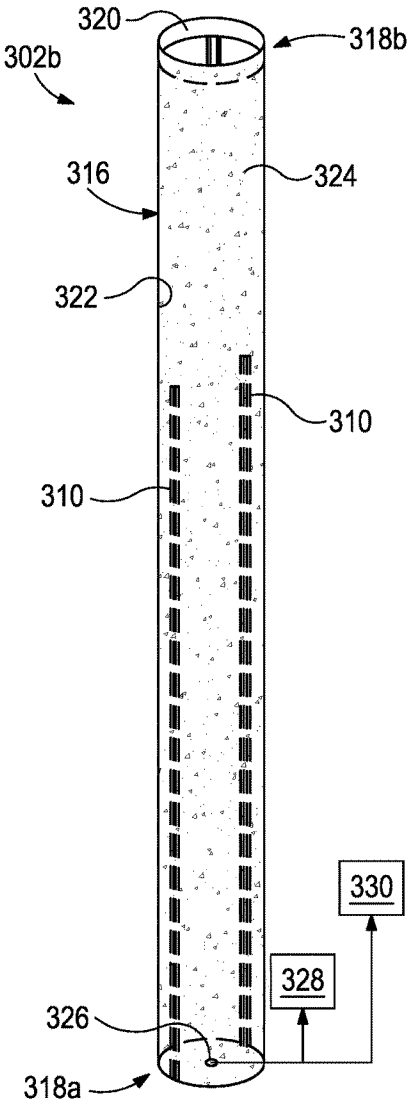
FIG. 3B is a schematic side view of another example insert tool, according to one or more additional embodiments of the present disclosure.
Figure 3A:
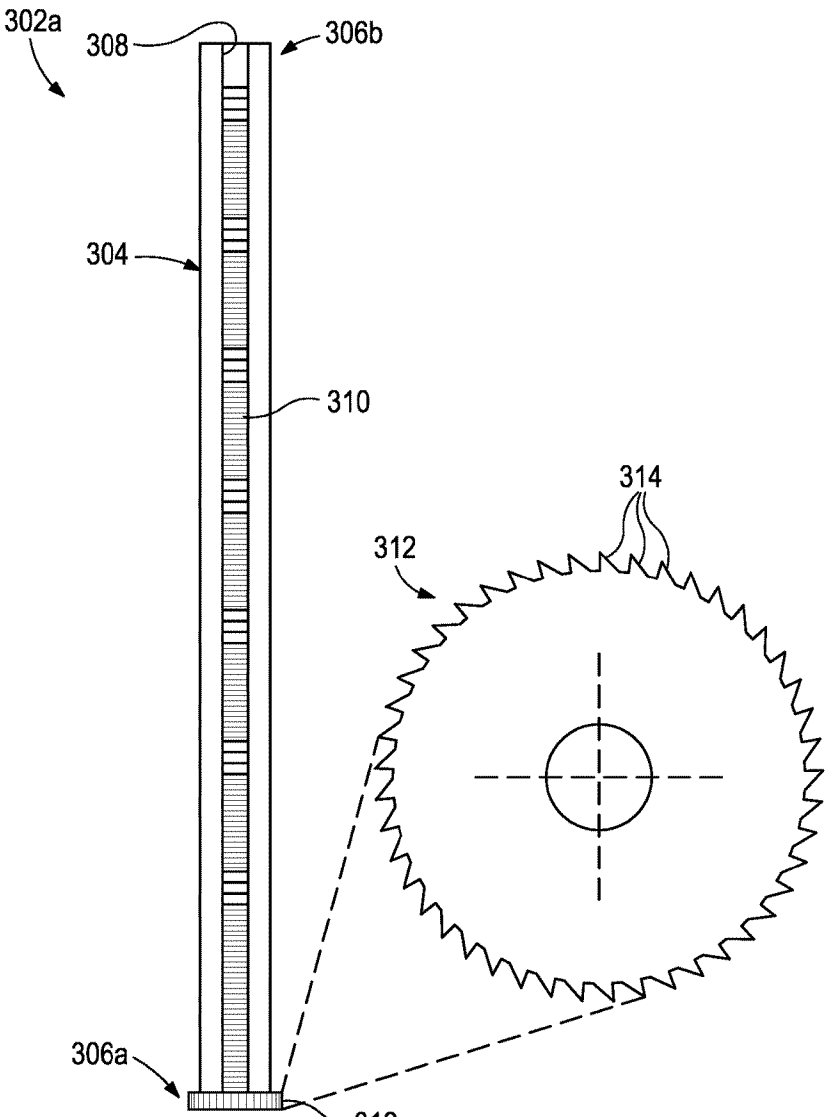
FIG. 3A is a schematic side view of an example insert tool, according to one or more embodiments of the present disclosure.

FIG. 3A is a schematic side view of an example insert tool 302*a*, according to one or more embodiments of the present disclosure. As illustrated, the insert tool 302*a* includes a generally elongate insert body 304 having a first or "lower end" 306*a* and a second or "upper" end 306*b* opposite the lower end 306*a*. In some embodiments, the insert body 304 may comprise a solid shaft, but could alternatively comprise a tubular structure, without departing from the scope of the present disclosure.

The insert tool 302*a* may be configured to be received within any of the insert chambers 208*a,b* (FIGS. 2B-2C), as generally described above. When received within a corresponding insert chamber 208*a,b*, the lower end 306*a* of the insert body 304 may be configured to be flush with the distal end 210*a* (FIG. 2D) of the primary insert chamber 208*a* (or secondary insert chamber 208*b*). In some embodiments, the insert body 304 may exhibit a generally circular cross-section and exhibit a diameter slightly smaller than the diameter of the corresponding insert chamber 208*a,b* where the insert tool 302*a* is to be mounted. This allows the insert tool 302*a* to be received within the corresponding insert chamber 208*a,b* and, in some embodiments, allows the insert tool 302*a* to be selectively rotated.

In some embodiments, as illustrated, a mounting receptacle 308 may be provided otherwise defined on the insert body 304 at the upper end 306*b*. The mounting receptacle 308 may comprise an orifice or pocket sized and otherwise configured to receive or mate with the mounting member 212 (FIG. 2D) provided at the proximal end 210*b* (FIG. 2D) of the primary insert chamber 208*a* (FIG. 2D) or a secondary insert chamber 208*b* (FIGS. 2B and 2C). In other embodiments, however, the mounting receptacle 308 may alternatively be provided on the corresponding insert chamber 208*a,b*, and the mounting member 212 may instead be provided at the upper end 306*b* of the insert tool 302*a*, without departing from the scope of the disclosure.

In some embodiments, mating the mounting receptacle 308 with the mounting member 212 (FIG. 2D) may fix the insert tool 302*a* within the corresponding insert chamber 208*a,b* (FIGS. 2A-2C) such that the insert tool 302*a* is prevented from rotating or translating along the longitudinal axis of the corresponding insert chamber 208*a.b*. In such embodiments, the insert tool 302*a* may further include or otherwise provide one or more slips 310 defined on an outer surface of the insert body 304. In the illustrated embodiment, the slips 310 are provided continuously between the lower and upper ends 306*a,b*, but could alternatively be provided only in predetermined, discrete locations along the axial length of the insert body 304. In such embodiments, the slips 310 may be provided in two or more sets of slips axially offset from each other along the axial length of the insert body 304.

The slips 310 may be configured to engage and grippingly secure the outer circumference of the casing 114 (FIGS. 1 and 2D) and thereby prevent the casing 114 from migrating (reversing) out of the interior 206 (FIGS. 2B-2D) of the tool 116 (FIGS. 2A-2D) once received therein. The slips 310 may be made of a hard or hardened material capable of biting into and grippingly engaging the outer circumference of the casing 114. In at least one embodiment, the slips 310 may be angled upward and otherwise have an angled structure that allows the casing 114 to advance into the interior 206, but prevents the casing 114 from migrating (reversing) out of the interior 206 once received therein. Accordingly, the slips 310 may help anchor the tool 116 to the casing 114. As described in more detail below, once the casing 114 is received within the interior 206, the drill pipe 118 (FIGS. 1 and 2A) may be pulled uphole to engage the slips 310, and thereby place the casing 114 in tension as engaged with the tool 116. This may prove advantageous in undertaking a subsequent cutting operation of the casing 114. In other embodiments, however, the slips 310 may be engaged after the cutting operation, without departing from the scope of the disclosure.

In other embodiments, mating the mounting receptacle 308 with the mounting member 212 (FIG. 2D) may allow the insert tool 302*a* to rotate within the corresponding insert chamber 208*a,b* (FIGS. 2B-2C). More specifically, in such embodiments, the mounting member 212 may operate as a drive member that, once operatively coupled to the mounting receptacle 308, is able to rotate the insert tool 302*a*. In such embodiments, the mounting member 212 may comprise a drive shaft or the like operatively coupled to a motor configured to impart rotational torque to the mounting member 212 and thereby cause the interconnected insert tool 302*a* to rotate.

Moreover, in such embodiments, the slips 310 may be omitted, and the insert tool 302*a* may instead include a cutting element 312 attached to the insert body 304 and rotatable as the insert body 304 rotates within the corresponding insert chamber 208*a,b*. One or more bearings (not shown) may be arranged between the insert body 304 and the inner walls of the corresponding insert chamber 208*a,b* (FIGS. 2B-2C) to allow the insert body 304 to rotate. As illustrated, the cutting element 312 may be arranged at the lower end 306*a* of the insert body 304, and as shown in the enlarged inset graphic, the cutting element 312 may comprise a round, disc-shaped cutting structure providing and otherwise defining a plurality of cutting teeth 314. When the casing 114 (FIGS. 1 and 2D) is received within the interior 206 (FIGS. 2B-2D) of the tool 116 (FIGS. 2A-2D), the cutting teeth 314 may be configured to engage and cut the casing 114 as the cutting element 312 is rotated.

In yet other embodiments, mating the mounting receptacle 308 with the mounting member 212 (FIG. 2D), will fix the insert body 304 of the insert tool 302*a* within the corresponding insert chamber 208*a,b* (FIGS. 2B-2C), but allow the cutting element 312 to rotate independent of the insert body 304. In such embodiments, the slips 310 may be included on the insert body 304 and operate to help anchor the tool 116 (FIGS. 2A-2D) to the outer circumference of the casing 114 (FIGS. 1 and 2D), while the cutting element 312 will be driven in rotation independent of the insert body 304 to simultaneously cut the casing 114. Moreover, in such embodiments, operation and rotation of the cutting element 112 may be undertaken via a separate drive mechanism (not shown).

In even further embodiments, mating the mounting receptacle 308 with the mounting member 212 (FIG. 2D), will fix the insert body 304 and the cutting element 312 within the corresponding insert chamber 208*a,b* (FIGS. 2B-2C). In such embodiments, the cutting element 312 may nonetheless be able to engage and cut against the outer circumference of the casing 114 (FIGS. 1 and 2D) by rotating the entire tool 116 (FIGS. 2A-2D). In some embodiments, this can be accomplished through a motorized attachment (not shown) between the drill string 118 (FIGS. 1 and 2D) and the tool 116 and operable to rotate the tool 116 independent of the drill string 118. In other embodiments, this can be accomplished by rotating the entire drill string 118 and the interconnected tool 116. In either scenario, rotating the tool 116 relative to the casing 114 will allow the cutting teeth 314 to engage and cut the casing 114 as the cutting element 312 is moved about the outer circumference of the casing 114.

FIG. 3B is a schematic side view of another example insert tool 302*b*, according to one or more embodiments of the present disclosure. The insert tool 302*b* may be similar in some respects to the first insert tool 302*a* of FIG. 3A, and therefore may be best understood with reference thereto. As illustrated, the insert tool 302*b* includes a generally elongate insert body 316 having a first or "lower end" 318*a* and a second or "upper" end 318*b* opposite the lower end 318*a*. Similar to the insert tool 302*a*, the insert tool 302*b* is configured to be received within any of the insert chambers 208*a,b* (FIGS. 2B-2C). The insert body 316 may exhibit a generally circular cross-section and exhibit a diameter slightly smaller than the diameter of the corresponding insert chamber 208*a,b* where the insert tool 302*b* is to be mounted. When received within a corresponding insert chamber 208*a, b*, the lower end 318*a* of the insert body 316 may be configured to be flush with the distal end 210*a* (FIG. 2D) of the primary insert chamber 208*a* (or secondary insert chamber 208*b*).

A mounting receptacle 320 may be provided otherwise defined on the insert body 316 at the upper end 318*b*. Similar to the mounting receptacle 308 (FIG. 3A), the mounting receptacle 320 may be configured to receive or mate with the mounting member 212 (FIG. 2D) provided at the proximal end 210*b* (FIG. 2D) of the primary insert chamber 208*a* (FIG. 2D) or a secondary insert chamber 208*b* (FIGS. 2B and 2C). In at least one embodiment, mating the mounting receptacle 320 to the mounting member 212 fixes the insert tool 302*b* within the corresponding insert chamber 208*a,b* such that the insert tool 302*b* is prevented from rotating. In such embodiments, the insert tool 302*b* may further include or otherwise provide the slips 310 defined on the outer surface of the insert body 316. As described above, the slips 310 may be configured to engage and grippingly secure the outer circumference of the casing 114 (FIGS. 1 and 2D) and thereby prevent the casing 114 from migrating (reversing) out of the interior 206 (FIGS. 2B-2D) of the tool 116 (FIGS. 2A-2D) once received therein. Moreover, once the casing 114 is received within the interior 206, the drill pipe 118 (FIGS. 1 and 2A) may be pulled uphole to engage the slips 310, and thereby place the casing 114 in tension as engaged to the tool 116, which may help in subsequently cutting (severing) the casing 114.

In at least one embodiment, the insert body 316 may comprise a generally tubular structure that defines and otherwise provides a fluid container 322 configured to contain a chemical cutting fluid 324. The chemical cutting fluid 324 may comprise a chemical composition configured to react with the material of the casing 114 (FIGS. 1 and 2D), and thereby help destroy or at least weaken the bonds of the material. Weakening or destroying the bonds of the material of the casing 114 may prove advantageous in casing the process of fully severing the casing 114. Accordingly, reacting the chemical cutting fluid 324 with the material of the casing 114 may be characterized as a form of "cutting" the casing 114. In at least one embodiment, reacting the chemical cutting fluid 324 with the material of the casing 114 may result in a heat treatment reaction and causes the release of "plasma" capable of chemically degrading or dissolving (cutting into) the material of the casing 114.

In some embodiments, the chemical cutting fluid 324 may be discharged in conjunction with operation of the cutting element 312 (FIG. 3A) in cutting of the casing 114 (FIGS. 1 and 2D). In such embodiments, the second insert tool 302*b* may be arranged within one of the secondary insert chambers 208*b* (FIGS. 2B and 2C), and the first insert tool 302*a* (FIG. 3A) with the cutting element 312 may be arranged within one of the primary insert chambers 208*a* (FIGS. 2B-2C). Moreover, in such embodiments, the chemical cutting fluid 324 may be discharged prior to or during operation of the cutting element 312. In other embodiments, however, the chemical cutting fluid 324 may be discharged only after it is determined that operating the cutting element 312 could not successfully cut the casing 114. In such embodiments, the chemical cutting fluid 324 may be discharged to weaken the material of the casing 114, and the casing 114 may subsequently be placed in tension using the slips 310, as described above. Once the slips 310 are engaged, an overpull may be applied on the casing 114 via the drill string 118 (FIGS. 1 and 2A), and the weakened material of the casing 114 may separate, and thereby sever the casing 114. In yet other embodiments, the cutting elements 312 may be entirely omitted from the tool 116 (FIGS. 2A-2D). In such embodiments, discharge of the chemical cutting fluid 324 in combination with an overpull applied to the casing 114 may be sufficient to sever or cut the upper end of the casing 114.

The fluid container 322 may be generally scaled but may include an actuatable valve 326 arranged at or near the lower end 318*a* of the insert body 316. In other embodiments, however, the valve 326 may be arranged at other locations along the axial length of the insert body 316, without departing from the scope of the disclosure. The valve 326 may be actuatable to selectively release all or a portion of the chemical cutting fluid 324. In some embodiments, the valve 326 may be communicable coupled to a timer 328. The timer 328 may be programmed with a predetermined time limit, and upon expiration of the predetermined time limit, a signal may be sent to actuate the valve 328 and thereby release the chemical cutting fluid 324 from the fluid container 322. In other embodiments, the valve 326 may be in communication with a control unit 330 arranged, for example, at the service rig 102 (FIG. 1). In such embodiments, a well operator may be able to remotely communicate with and actuate the valve 326 from the service rig 102 or from another remote locations, without departing from the scope of the disclosure.

In at least one embodiment, the actuatable valve 326 may form part of an explosive discharge system designed to forcefully eject and discharge the chemical cutting fluid 324 at high-pressures. In such embodiments, the chemical cutting fluid 324 may comprise a highly corrosive material, such as a propellant chemical halogen fluoride. Moreover, in such embodiments, the actuatable valve 326 may be configured to trigger a small explosive charge that forcefully directs high-pressure impact of the chemical cutting fluid 324 in a circumferential pattern against the casing 114 (FIGS. 1 and 2D), which then results in a chemical reaction and degradation of the metal. In embodiments where the chemical cutting fluid 324 comprises a propellant chemical halogen fluoride, the chemical cutting fluid 324 may burn the circumferential area covered of the adjacent casing 114, thereby resulting in weakening of the material, which makes it easy to be parted and dismantled.

Figure 4A:
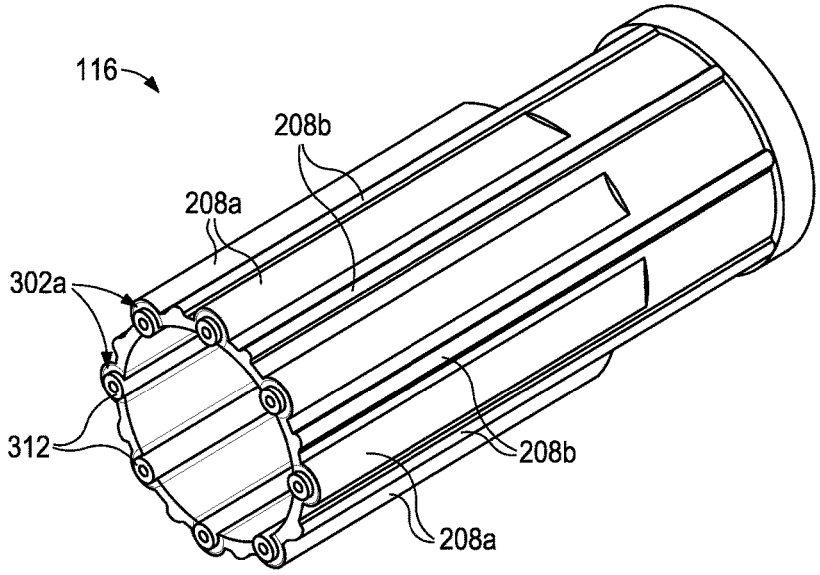
FIGS. 4A, 4B, and 4C are isometric, end, and cross-sectional side views, respectively of the downhole workover tool of FIGS. 2A-2D having one or more insert tools installed thereon, according to one or more embodiments.
Figure 4B:
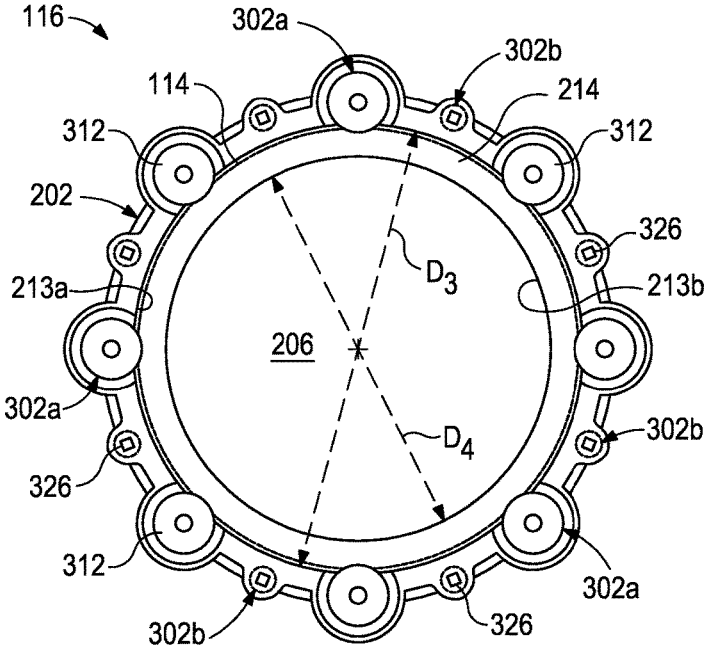
Figure 4C:
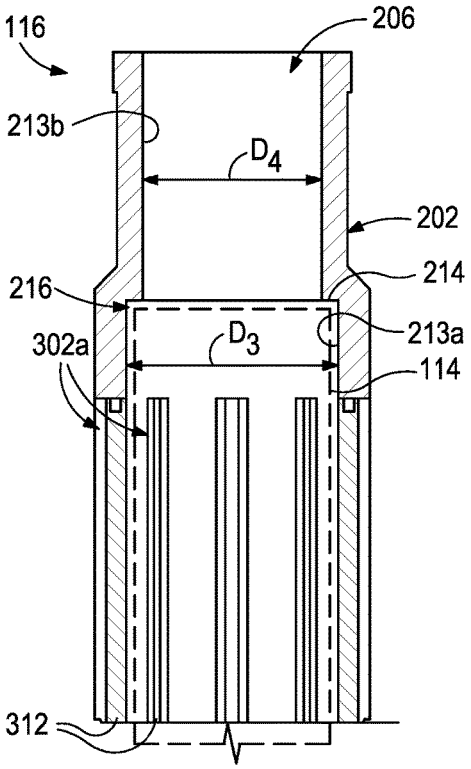

FIGS. 4A, 4B, and 4C are isometric, end, and cross-sectional side views, respectively, of the tool 116 having one or more insert tools 302*a,b* installed thereon, according to one or more embodiments. In the illustrated embodiment, corresponding first insert tools 302*a* are mounted within each of the primary insert chambers 208*a*, and as best seen in FIG. 4B, corresponding second insert tools 302*b* (shown in dashed lines) are mounted within each of the secondary insert chambers 208*b*. Moreover, each first insert tool 302*a* includes a corresponding cutting element 312, and each second insert tool 302*b* includes a corresponding actuatable valve 326 (FIG. 4B). While a corresponding first insert tool 302*a* is shown installed in every primary insert chamber 208*a*, in other embodiments, one or more of the primary insert chambers 208*a* may have mounted therein one of the second insert tools 302*b*. Similarly while a corresponding second insert tool 302*b* is shown installed in every secondary insert chamber 208*b*, in other embodiments, one or more of the secondary insert chambers 208*b* may have mounted therein one of the first insert tools 302*a*, without departing from the scope of the disclosure.

Referring to FIGS. 4B and 4C, the lower section 213*a* of the interior 206 of the body 202 may exhibit a first diameter $D_3$, and the upper section 213*b* of the interior 206 may exhibit a second diameter $D_4$, where the first diameter $D_3$ is larger than the second diameter $D_4$. The first diameter $D_3$ transitions to the second diameter $D_4$ at the radial shoulder 214. As discussed above, the lower section 213*a* of the interior 206 may be sized and otherwise configured to receive the upper end 216 of the casing 114 (shown in dashed lines). As best seen in FIG. 4B, the cutting elements 312 extend a short distance into the volume of the lower section 213*a*, thus enabling the cutting elements 312 to be able to engage the outer circumference of the casing 114 and cut the casing 114.

Example operation of the tool 116 will now be provided, in conjunction with the system 100 of FIG. 1. The tool 116 may be conveyed into the wellbore 106 on the drill pipe 118 until locating and mating with the upper end 216 of the casing 114. More specifically, the upper end 216 of the casing 114 may be received within the interior 206 of the tool 116 and advanced until engaging the radial shoulder 214. In some embodiments, one or more of the insert tools 302*a,b* may be arranged within the primary insert chambers 208*a* and may include the slips 310 (FIGS. 3A-3B) configured to engage and grippingly secure the outer circumference of the casing 114 and thereby prevent the casing 114 from migrating (reversing) out of the interior 206 once received therein. Once the casing 114 is received within the interior 206, the drill pipe 118 may be pulled uphole to engage the slips 310, and thereby place the casing 114 in tension as engaged with the tool 116. In some embodiments, the slips 310 may be engaged prior to attempting to cut the casing 114, but in other embodiments, the slips 310 may be engaged after the casing 114 has been at least partially cut (severed).

In some embodiments, one or more of the insert tools 302*a,b* arranged within the primary insert chambers 208*a* may include the cutting element 312 configured to engage and cut the casing 114 as the cutting element 312 is rotated relative to the casing 114, as generally described above. In some embodiments, the cutting elements 312 may be situated to be able to cut entirely through the sidewall of the casing 114. In other embodiments, however, the cutting elements 312 may be situated to cut only partly through the sidewall of the casing 114. In such embodiments, overpull tension applied to the casing 114 via the tool 116 may help sever the casing 114 defined by the cutting elements 312.

In some embodiments, one or more of the second insert tools 302*b* may be arranged within corresponding secondary insert chambers 208*b* and configured to house the chemical cutting fluid 324 (FIG. 3B) within corresponding fluid containers 322 (FIG. 3B). The chemical cutting fluid 324 may be selectively discharged from the corresponding fluid container 322 by actuating the corresponding valve 326. Upon contacting the material of the casing 114, the chemical cutting fluid 324 reacts with the material and thereby helps destroy or at least weaken the bonds of the material. In conjunction with the cutting operation undertaken by the cutting elements 312, the chemical cutting fluid 324 may help cut or sever the casing 114. As indicated above, the chemical cutting fluid 324 may be discharged prior to or during operation of the cutting element 312, but could alternatively be selectively discharged with or without the cutting action of the cutting elements 312. In such embodiments, discharge of the chemical cutting fluid 324 in combination with an overpull applied to the casing 114 via the drill string 118 may be sufficient to sever or cut the upper end of the casing 114.

Figure 5A:
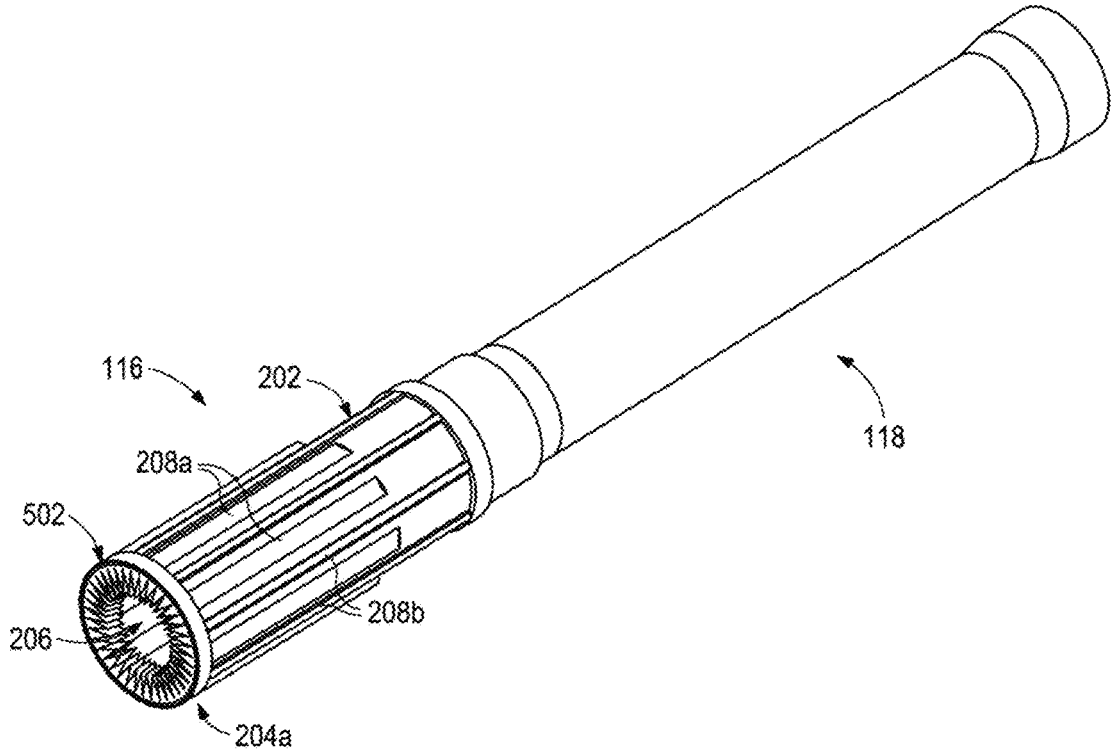
FIG. 5A is an isometric view of another example of the downhole workover tool of FIG. 1, according to one or more embodiments.

FIG. 5A is an isometric view of another example of the tool 116, according to one or more embodiments. The tool 116 shown in FIG. 5A may be similar in some respects to the tool 116 described with reference to FIGS. 2A-2D, and therefore may be best understood reference thereto, where like numerals will correspond to like elements or components not described again in detail. Similar to the tool 116 of FIGS. 2A-2D, the tool 116 in FIG. 5A may be operatively coupled to the drill pipe 118. Moreover, the tool 116 may include the body 202 that provides and otherwise defines a plurality of primary and secondary insert chambers 208*a,b*, and each insert chamber 208*a,b* may be configured to receive a corresponding one of the insert tools 302*a,b* (FIGS. 3A-3B).

Unlike the tool 116 of FIGS. 2A-2D, however, the tool 116 of FIG. 5A may include a rotatable cutter 502 mounted to the lower end 204*a* of the body 202. The independent rotatable cutter 502 (hereafter "the cutter 502") may be configured to cut into the outer circumference of the casing 114 (FIG. 1). In some embodiments, the cutter 502 may be rotatable independent of the tool 116. In such embodiments, the cutter 502 may be rotatably mounted to the lower end 204*a* of the body 202 and operatively coupled to a motor or servo (not shown) configured to rotate the cutter 502 relative to the body 202. In other embodiments, however, the cutter 502 may be fixed to the lower end 204 of the body 202. In such embodiments, the cutter 502 may be able to cut into the outer circumference of the casing 114 by rotating the entire tool 116, as rotated by the drill pipe 118 or via a motorized attachment (not shown) between the drill string 118 and the tool 116 and operable to rotate the tool 116 independent of the drill string 118. In either scenario, rotating the tool 116 relative to the casing 114 will allow the cutter 502 to engage and cut the casing 114 as the cutter 502 is moved about the outer circumference of the casing 114.

In some embodiments, operation of the cutter 502 may occur before the tool 116 is anchored to the upper end of the casing 114 (FIG. 1). In other embodiments, however, operation of the cutter 502 may occur after the tool 116 is properly anchored to the upper end of the casing 114 and the casing 114 is placed in tension. Incorporation of the cutter 502 may prove advantageous in allowing some or all of the insert chambers 208*a,b* to receive corresponding insert tools 302*a,b* (FIGS. 3A-3B) with slips 310 (FIGS. 3A-3B) operable to engage and grippingly secure the outer circumference of the casing 114 and thereby prevent the casing 114 from migrating (reversing) out of the interior 206 of the tool 116 once received therein. Accordingly, this may prove advantageous in increasing the anchoring ability of the tool 116.

Incorporation of the cutter 502 may also prove advantageous in allowing some or all of the insert chambers 208*a,b* to receive corresponding insert tools 302*b* (FIG. 3B) that define the fluid container 322 (FIG. 3B) configured to contain the chemical cutting fluid 324 (FIG. 3B). Accordingly this may prove advantageous in increasing the ability of the tool 116 to chemically weaken or destroy the bonds of the material of the casing 114 with corresponding discharge of the chemical cutting fluid from a greater number of fluid container 322. In some embodiments, the chemical cutting fluid 324 may be discharged in conjunction with operation of the cutter 502. In such embodiments, the chemical cutting fluid 324 may be discharged prior to or during operation of the cutter 502. In other embodiments, however, the chemical cutting fluid 324 may be discharged only after it is determined that operating the cutter 502 could not successfully cut the casing 114. In such embodiments, the chemical cutting fluid 324 may be discharged to weaken the material of the casing 114, and the casing 114 may subsequently be placed in overpull tension using the slips 310 (FIGS. 3A-3B), as described above, which helps sever the casing 114.

Figure 5B:
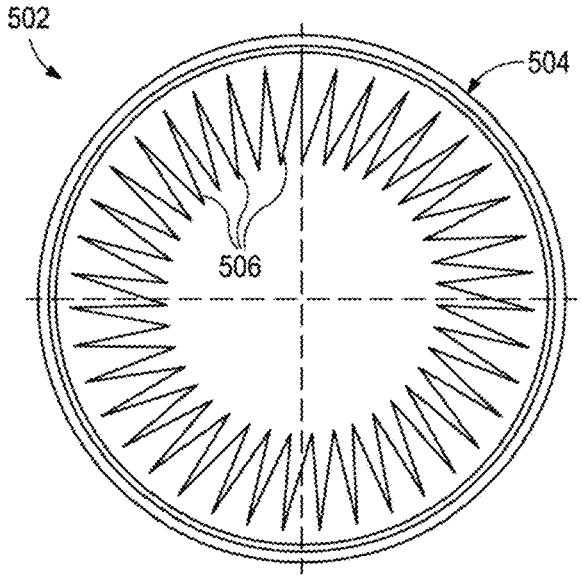
FIGS. 5B and 5C are schematic end and isometric views, respectively, of the rotatable cutter of FIG. 5A, according to one or more embodiments.
Figure 5C:
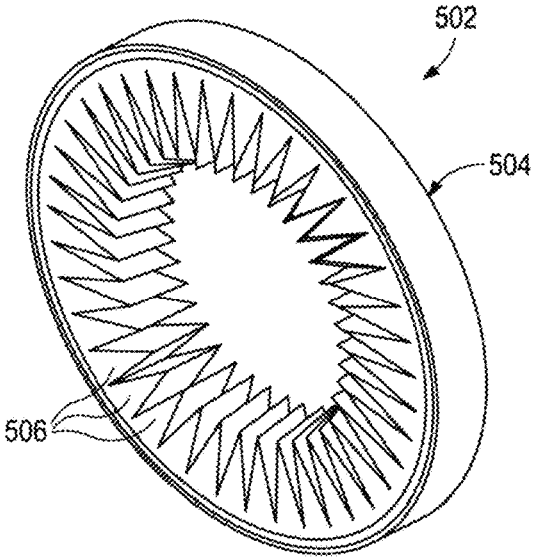

FIGS. 5B and 5C are schematic end and isometric views, respectively, of the cutter 502, according to one or more embodiments. As illustrated, the cutter 502 includes a generally circular body 504. In some embodiments, the body 504 may be fixed to the lower end 204*a* (FIG. 5A) of the tool 116 (FIG. 5A), but as indicated above, the body 504 may alternatively be rotatably mounted to the lower end 204*a*, without departing from the scope of the disclosure. In such embodiments, the body 504 may comprise a type of annular bearing that allows at least a portion of the cutter 502 to rotate relative to other portions.

As illustrated, the cutter 502 provides and otherwise defines a plurality of cutting teeth 506 that extend radially inward from the body 504. When the casing 114 (FIGS. 1 and 2D) is received within the interior 206 (FIG. 5A) of the tool 116 (FIGS. 2A-2D), the cutting teeth 506 may be configured to engage and cut the casing 114 as the cutter 502 is rotated.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising." and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A downhole workover tool, comprising:

an elongate, cylindrical body having opposing lower and upper ends and defining an interior sized to receive an upper portion of a wellbore tubular via the lower end;

a plurality of insert chambers provided about an outer circumference of the body, at least one of the insert chambers comprising a longitudinally extending rib defined on an outer radial surface of the body and extending radially outward therefrom; and a plurality of insert tools receivable within the plurality of insert chambers, at least one of the plurality of insert tools providing slips operable to grippingly engage an outer circumference of the upper portion of the wellbore tubular and thereby prevent the upper portion of the wellbore tubular from reversing out of the interior once received therein, wherein the plurality of insert tools include one or more first insert tools, each first insert tool including:

an elongate insert body having opposing lower and upper ends and sized to be received within a corresponding one of the plurality of insert chambers; and a cutting element mounted to the lower end of the insert body and providing a plurality of cutting teeth engageable with the outer circumference of the upper portion of the wellbore tubular to cut into the upper portion of the wellbore tubular.

2. The downhole workover tool of claim 1, wherein the plurality of insert chambers comprise:

a plurality of primary insert chambers exhibiting a first diameter; and a plurality of secondary insert chambers exhibiting a second diameter smaller than the first diameter.

3. The downhole workover tool of claim 2, wherein the pluralities of primary and secondary insert chambers alternate about the outer circumference of the body.

4. The downhole workover tool of claim 1, wherein the elongate insert body is rotatably mounted within the corresponding one of the plurality of insert chambers and rotated to correspondingly rotate the cutting element and thereby cut into the upper portion of the wellbore tubular.

5. The downhole workover tool of claim 1, wherein the elongate insert body is fixed within the corresponding one of the plurality of insert chambers and the cutting element is rotatably mounted to the lower end of the insert body and driven in rotation independent of the insert body to cut into the upper portion of the wellbore tubular.

6. The downhole workover tool of claim 1, wherein the plurality of insert tools further include one or more second insert tools, each second insert tool including:

an elongate insert body having opposing lower and upper ends and sized to be received within a corresponding one of the plurality of insert chambers;

a fluid container defined within the insert body; and a chemical cutting fluid contained within the fluid container and selectively dischargeable from the fluid container to react with and weaken bonds of a material of the wellbore tubular.

7. The downhole workover tool of claim 6, wherein each second insert tool further includes a valve arranged at or near the lower end of the insert body and selectively actuatable to release the chemical cutting fluid from the fluid container.

8. The downhole workover tool of claim 7, wherein each second insert tool further includes a timer communicably coupled to the valve and programmed to actuate the valve upon expiration of a predetermined time limit.

9. The downhole workover tool of claim 1, further comprising a rotatable cutter mounted to the lower end of the body and including a plurality of cutting teeth engageable with the outer circumference of the upper portion of the wellbore tubular to cut into the upper portion of the wellbore tubular.

10. The downhole workover tool of claim 9, wherein the rotatable cutter is rotatably mounted to the lower end of the body and rotatable independent of the body.

11. The downhole workover tool of claim 1, wherein the at least one of the plurality of insert chambers provides opposing distal and proximal ends, and wherein the distal end aligns flush with the lower end of the body.

12. A method of undertaking a workover operation, comprising:

conveying a downhole workover tool into a wellbore having a wellbore tubular positioned therein, the downhole workover tool including:

an elongate, cylindrical body having opposing lower and upper ends and defining an interior;

a plurality of insert chambers provided about an outer circumference of the body, at least one of the plurality of insert chambers comprising a longitudinally extending rib defined on an outer radial surface of the body and extending radially outward therefrom; and a plurality of insert tools receivable within the plurality of insert chambers, at least one of the plurality of insert tools including an elongate insert body having opposing lower and upper ends and a cutting element mounted to the lower end of the insert body;

receiving an upper portion of the wellbore tubular into the interior via the lower end of the body;

anchoring the downhole workover tool to the upper portion of the wellbore tubular by grippingly engaging an outer circumference of the upper portion of the wellbore tubular with at least one of the plurality of insert tools; and cutting into the upper portion of the wellbore tubular by engaging the outer circumference of the upper portion of the wellbore tubular with a plurality of cutting teeth provided on the cutting element, and cutting into the upper portion of the wellbore tubular with the plurality of cutting teeth.

13. The method of claim 12, wherein the at least one of the plurality of insert tools includes an elongate second insert body having opposing lower and upper ends, a fluid container defined within the second insert body, and a chemical cutting fluid contained within the fluid container, and wherein cutting into the upper portion of the wellbore tubular with the at least one of the plurality of insert tools further comprises:

selectively discharging the chemical cutting fluid from the fluid container to react with and weaken bonds of a material of the wellbore tubular.

14. The method of claim 12, wherein the downhole workover tool is conveyed into the wellbore connected to drill pipe, and wherein anchoring the downhole workover tool to the upper portion of the wellbore tubular further comprises:

placing the wellbore tubular in tension by generating an overpull on the downhole workover tool with the drill string.

15. A downhole workover tool, comprising:

an elongate, cylindrical body having opposing lower and upper ends and defining an interior sized to receive an upper portion of a wellbore tubular via the lower end;

a plurality of insert chambers provided about an outer circumference of the body, at least one of the insert chambers comprising a longitudinally extending rib defined on an outer radial surface of the body and extending radially outward therefrom; and a plurality of insert tools receivable within the plurality of insert chambers, at least one of the plurality of insert tools providing slips operable to grippingly engage an outer circumference of the upper portion of the wellbore tubular and thereby prevent the upper portion of the wellbore tubular from reversing out of the interior once received therein, wherein the plurality of insert tools include one or more second insert tools, each second insert tool including:

an elongate insert body having opposing lower and upper ends and sized to be received within a corresponding one of the plurality of insert chambers;

a fluid container defined within the insert body; and a chemical cutting fluid contained within the fluid container and selectively dischargeable from the fluid container to react with and weaken bonds of a material of the wellbore tubular.

16. The downhole workover tool of claim 15, wherein each second insert tool further includes a valve arranged at or near the lower end of the insert body and selectively actuatable to release the chemical cutting fluid from the fluid container.

17. The downhole workover tool of claim 16, wherein each second insert tool further includes a timer communicably coupled to the valve and programmed to actuate the valve upon expiration of a predetermined time limit.

* * * * *